US011305792B2

(12) United States Patent
Hankinson

(10) Patent No.: US 11,305,792 B2
(45) Date of Patent: Apr. 19, 2022

(54) RAILROAD CAR COUPLER ASSEMBLY KNUCKLE PIN

(71) Applicant: Standard Car Truck Company, Rosemont, IL (US)

(72) Inventor: Stephen Hankinson, Mars, PA (US)

(73) Assignee: Standard Car Truck Company, Rosemont, IL (US)

( * ) Notice: Subject to any disclaimer, the term of this patent is extended or adjusted under 35 U.S.C. 154(b) by 410 days.

(21) Appl. No.: 16/443,059

(22) Filed: Jun. 17, 2019

(65) Prior Publication Data

US 2019/0389495 A1 Dec. 26, 2019

Related U.S. Application Data

(60) Provisional application No. 62/687,359, filed on Jun. 20, 2018.

(51) Int. Cl.
*B61G 3/06* (2006.01)
*B61G 1/28* (2006.01)

(52) U.S. Cl.
CPC ..... *B61G 3/06* (2013.01); *B61G 1/28* (2013.01)

(58) Field of Classification Search
CPC ..... B61G 1/28; B61G 3/06
See application file for complete search history.

(56) References Cited

U.S. PATENT DOCUMENTS

| | | | | |
|---|---|---|---|---|
| 440,586 | A | 11/1890 | Eastwick, Jr. | |
| 478,446 | A | 7/1892 | Ludlow | |
| 577,389 | A | 2/1897 | Reagan | |
| 1,089,396 | A | 3/1914 | Coleman | |
| 2,857,057 | A | 10/1958 | Metzger | |
| 4,640,422 | A | 2/1987 | Elliott | |
| 4,976,363 | A | 12/1990 | Altherr | |
| 5,145,076 | A | 9/1992 | Murphy et al. | |
| 5,630,519 | A | 5/1997 | Burke et al. | |
| 6,488,163 | B1 | 12/2002 | Wurzer et al. | |
| 7,896,179 | B2 | 3/2011 | Hanaway | |
| 8,910,808 | B2 * | 12/2014 | Halford | B61G 3/04 213/155 |

* cited by examiner

*Primary Examiner* — Robert J McCarry, Jr.
(74) *Attorney, Agent, or Firm* — McCoy Russell LLP

(57) ABSTRACT

A railroad car coupler assembly knuckle pin including an elongated cylindrical tubular body having an upper end portion, a lower end portion spaced apart from the upper end portion, and an intermediate portion between and connecting the upper end portion and the lower end portion, the body including an elongated cylindrical wall that defines an elongated cylindrical central opening and an elongated slot that extends the length of the wall, a first ring integrally connected to and outwardly extending from a first area of the upper end portion of the body, a second ring integrally connected to and outwardly extending from a second area of the upper end portion of the body, the second ring spaced apart from the first ring along the body, the first ring defining a plurality of first stress relief slots, and the second ring defining a plurality of second stress relief slots.

15 Claims, 16 Drawing Sheets

RAILROAD CAR COUPLER ASSEMBLY KNUCKLE PIN

PRIORITY

This application claims priority to and the benefit of U.S. Provisional Patent Application No. 62/687,359, filed Jun. 20, 2018, the entire contents of which are incorporated herein by reference.

CROSS REFERENCE TO RELATED APPLICATIONS

This application is related to the following commonly owned co-pending patent application: U.S. application Ser. No. 29/653,953, entitled "RAILROAD CAR COUPLER ASSEMBLY KNUCKLE PIN."

BACKGROUND

Conventional freight railroad cars in North America and other parts of the world typically include an elongated frame, a car body mounted on the frame, and two spaced apart trucks that support the frame. These conventional freight railroad cars also typically include coupler assemblies respectively mounted at and to opposite ends of the frame for respective connections to adjacent railroad cars in a train. Each coupler assembly typically includes, among other components, a coupler and a knuckle pivotally attached to the coupler by a knuckle pin. The knuckle pin pivotally connects the knuckle to the coupler. During the coupling process, when two respective coupler assemblies of adjacent railroad cars are attached, the respective knuckles snap closed. A detailed description of a railway car coupler assembly and the operation of a knuckle pin are described in U.S. Pat. No. 5,145,076.

When two adjacent railroad cars are coupled to each other, the respective knuckles of the opposing coupler assemblies are engaged, and the forces produced during buff and draft movements of these railroad cars are transmitted through the knuckles and the couplers of the respective coupler assemblies. Under normal operation, a knuckle pin experiences minimal forces during such buff and draft movements of the railroad cars. When these or other components of the coupler assemblies (or other parts of the railroad car) are worn or damage (due to usage or other reasons), additional forces (such as bending forces) can be applied to the knuckle pins. Conventional knuckle pins used in the railroad industry are defined by various American Association of Railroads ("AAR") standards including M-118, and include a solid cylindrical body that is heat treated to achieve higher hardness and material strengths. When additional forces are applied to such a conventional knuckle pin with a solid cylindrical body, the knuckle pin can experience stresses beyond material limits due to inherent rigidity of the knuckle pin. Conventional knuckle pins have limited to no ability to elastically deform to facilitate the intended load transfer between the knuckle and coupler of the coupler assembly. Failure of conventional knuckle pins during operation thus occurs at various times during operation of known railroad cars. Such failures require replacement of the failed knuckle pin prior to successful operation (i.e., closing and opening) of the knuckle attached to the coupler of the coupler assembly.

U.S. Pat. No. 6,488,163 describes an alternative style knuckle pin with a longitudinally extending slot that is configured to withstand such bending forces. However, this knuckle pin has not been widely commercially adopted by the railroad industry.

There is a continuing demand in the railroad industry to improve various components of railroad car including knuckle pins.

SUMMARY

Various embodiments of the present disclosure provide new railroad car coupler assembly knuckle pins, new railroad car coupler assemblies with such new knuckle pins, and new railroad cars with such new coupler assemblies having such new knuckle pins.

In various embodiments, the knuckle pin of the present disclosure includes an elongated generally cylindrical tubular body having an upper end portion, a lower end portion spaced apart from the upper end portion, and an intermediate portion between and connecting the upper end portion and the lower end portion. The body includes an elongated generally cylindrical wall having a generally cylindrical outer surface and a generally cylindrical inner surface that defines an elongated generally cylindrical central opening that extends the entire length of the body. The wall includes two spaced apart elongated opposing surfaces that define an elongated slot that extends the entire length of the wall. The knuckle pin further includes a first generally annular ring integrally connected to and outwardly extending from a first area of the upper end portion of the body, and a second generally annular ring integrally connected to and outwardly extending from a second area of the upper end portion of the body. The second ring is spaced apart from the first ring along the body. The first ring defines a plurality of first stress relief slots. The second ring defines a plurality of second stress relief slots. The stress relief slots not only provide stress relief of the rings during knuckle pin loading conditions, but also permit increased radial displacement to occur under elastic conditions. By incorporating a plurality of stress relief slots, the knuckle pin has an increased ability to deform radially. The first ring is sized diametrically larger than a knuckle pin opening in a coupler. The second ring is also sized diametrically larger than a knuckle pin opening in a coupler. This multi-ring configuration enables the second ring to prevent the knuckle pin from falling through the coupler if the first ring breaks off from the body of the knuckle pin. This multi-ring configuration also enables a person to easily grip the knuckle pin and remove the knuckle pin from the coupler.

In certain such embodiments, the opposing surfaces that define the elongated slot extend in intersecting planes. In certain such embodiments, the opposing surface that defines the elongated slot extends in parallel planes. In certain such embodiments, the opposing surfaces that define the elongated slot extend in a non-linear manner. In certain such embodiments, one or more parts of the elongated slot are non-vertically configured.

In certain such embodiments, the opposing surfaces that define one or more of the stress relief slots extend in intersecting planes. In certain such embodiments, the opposing surface that define one or more of the stress relief slots extends in parallel planes. In certain such embodiments, the opposing surfaces that define one or more of the stress relief slots extend in a non-linear manner. In certain such embodiments, one or more parts of one or more of stress relief slots are non-vertically configured.

In certain such embodiments, the first ring includes four equally sized sections, each section includes a curved wall having a top surface, a bottom surface, a concave inner surface integrally connected to the outer surface of the wall of the body, a convex outer surface, a first end surface that partially defines one of the first stress relief slots, and a second end surface that partially defines another one of the first stress relief slots.

In certain such embodiments, the second ring also includes four equally sized sections, each section includes a curved wall having a top surface, a bottom surface, a concave inner surface integrally connected to the outer surface of the wall of the body, a convex outer surface, a first end surface that partially defines one of the second stress relief slots, and a second end surface that partially defines another one of the second stress relief slots.

In certain such embodiments, the body, the first ring, and the second ring are monolithically formed. In certain such embodiments, the body is steel, the first ring is steel, the first ring is welded to the outer surface of the wall of the body, the second ring is steel, and the second ring is welded to the outer surface of the wall of the body.

In certain such embodiments, the lower end portion of the body defines a plurality of spaced apart aligned fastener receipt holes.

In various embodiments, the present disclosure thus provides an improved knuckle pin that facilitates easier assembly and disassembly of the coupler assembly while maintaining or improving the ability to radially deform in the material elastic regime.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
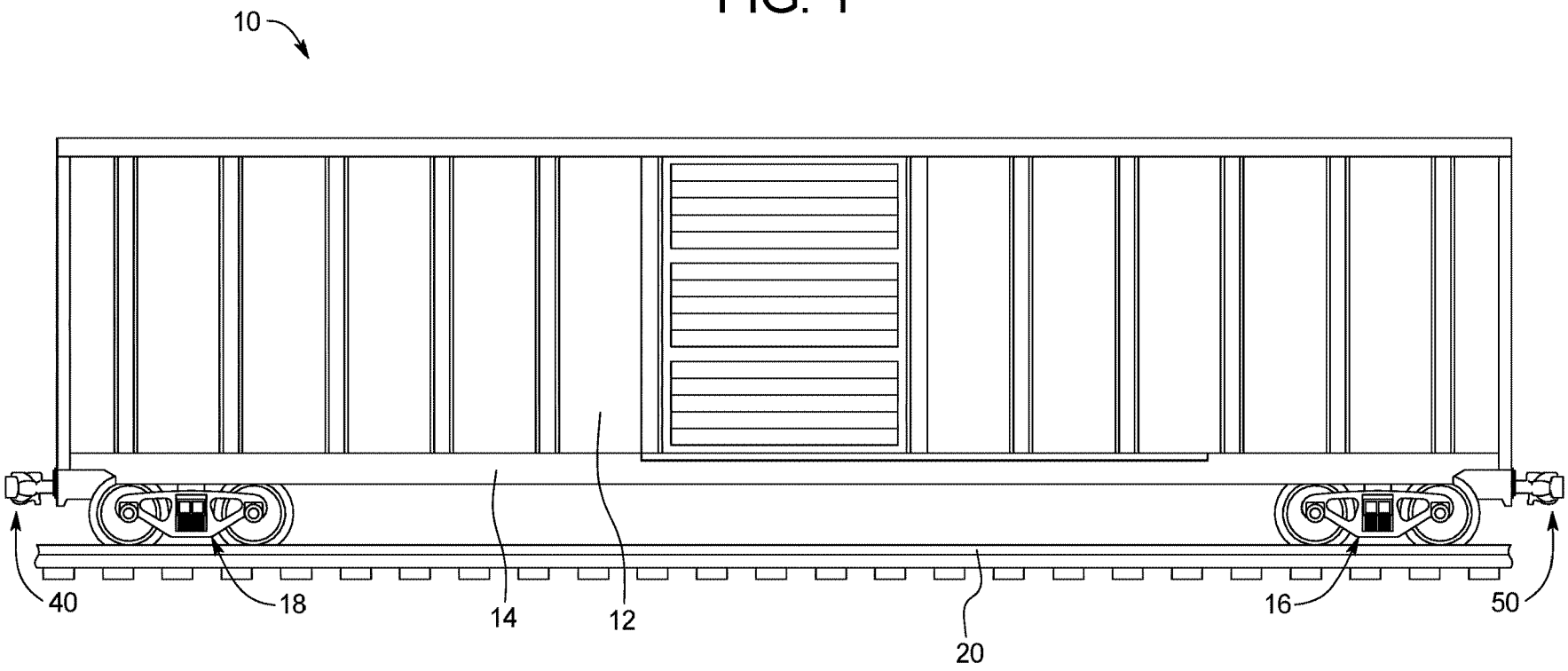
FIG. 1 is a side view of an example freight railroad car of the present disclosure positioned on conventional railroad tracks.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected and like mounting methods. This specification is intended to be taken as a whole and interpreted in accordance with the principles of the present disclosure and as understood by one of ordinary skill in the art.

Referring now to the drawings, FIG. 1 illustrates an example freight railroad car indicated by numeral 10 that knuckle pins of the present disclosure can be employed in. This example railroad car 10 generally includes a car body 12 mounted on a frame 14, a first truck 16, and a second truck 18. The railroad car 10 is configured to roll along the tracks 20 via the first truck 16 and the second truck 18 in a conventional manner. The car body 12 and the frame 14 rotatably rests on the first truck 16 and the second truck 18 in a conventional manner to navigate (e.g., accommodate, traverse, etc.) curves (not shown) in the tracks 20. The railroad car 10 includes first and second coupler assemblies 40 and 50 at opposite ends of the car body 12. Each coupler assembly is configured to facilitate attachment of the railroad car 10 to an adjacent railroad car (not shown). The various components of the railroad car and the coupler assemblies that are not shown can be conventional or new components (as will be appreciated by one of ordinary skill in the art) and will thus not be described herein.

Figure 2:
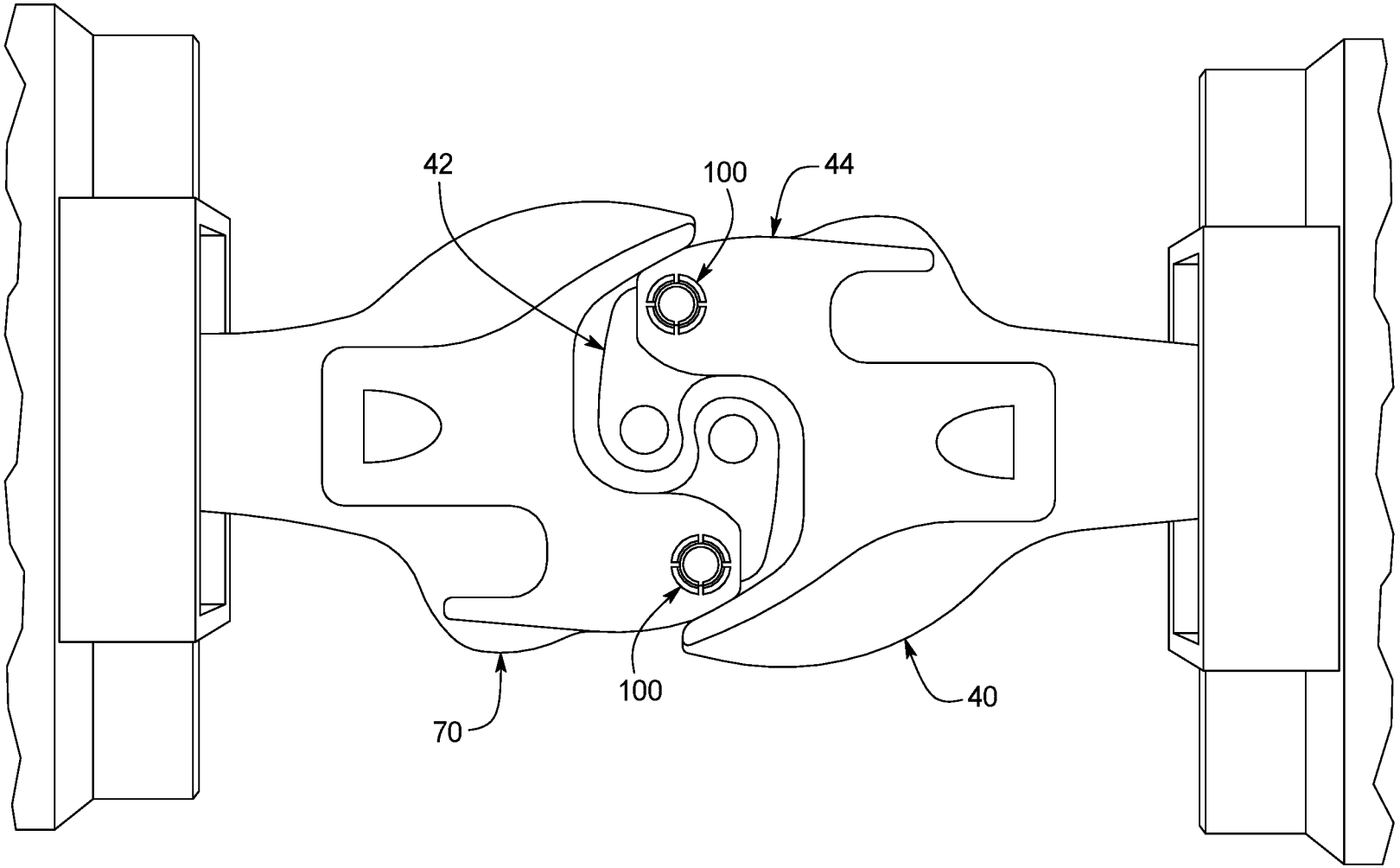
FIG. 2 is fragmentary top view of two adjacent connected coupler assemblies of two adjacent railroad cars (such as one of the coupler assemblies of the example freight railroad car of FIG. 1), wherein each coupler assembly includes a knuckle pin of the first example embodiment of the present disclosure.
Figure 3:
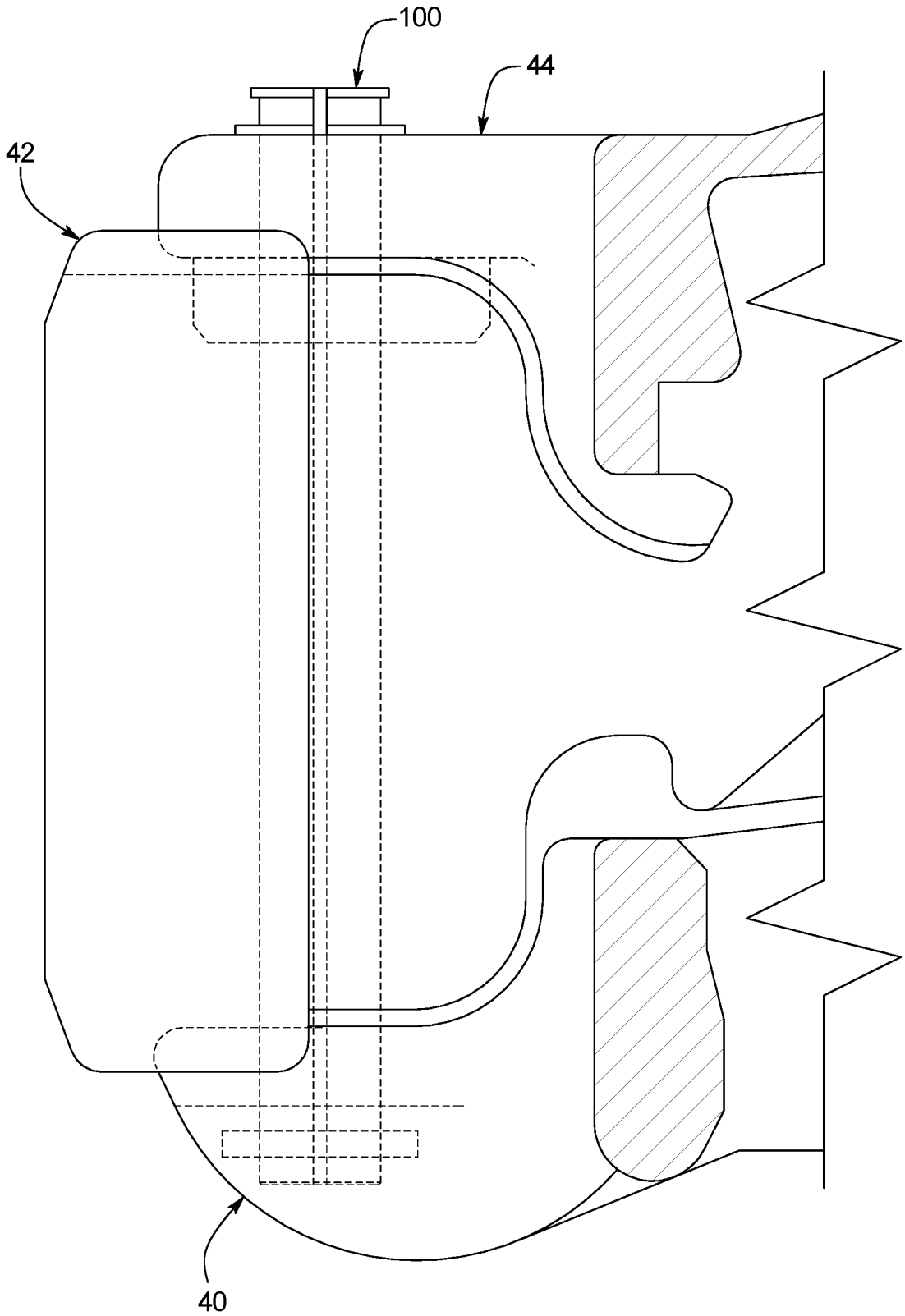
FIG. 3 is a fragmentary side view of one of the coupler assemblies of FIG. 2, showing one of the knuckle pins of FIG. 2 partially in phantom.
Figure 4:
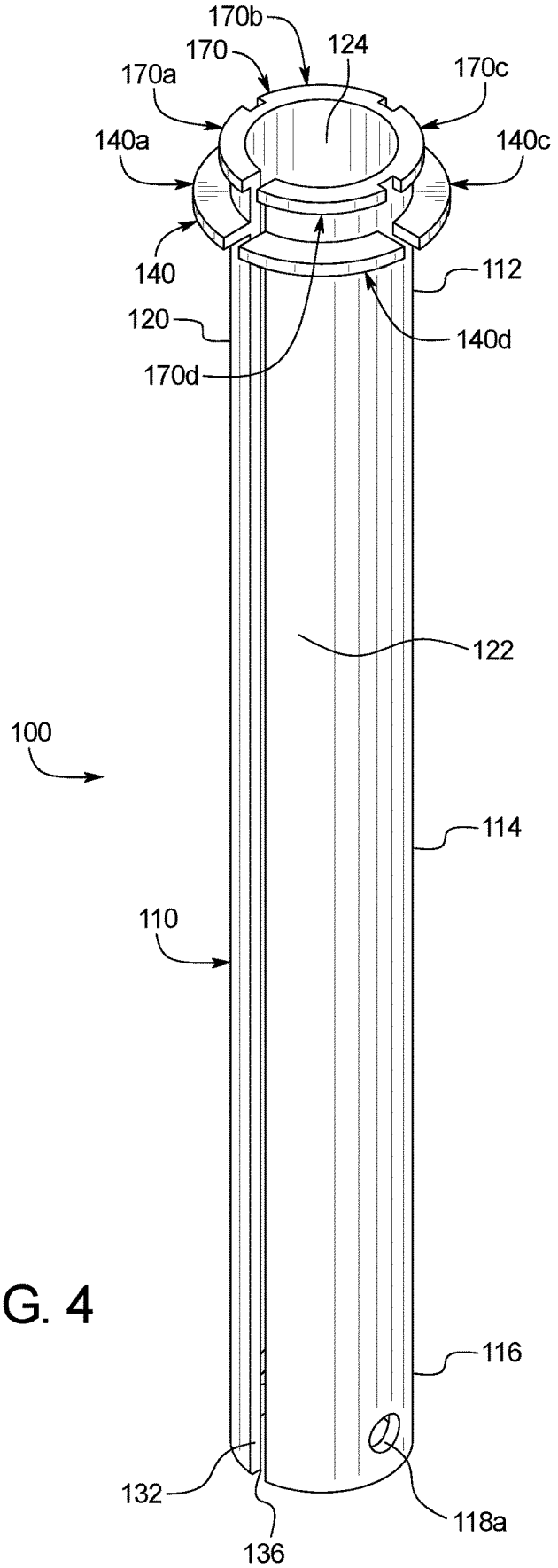
FIG. 4 is a first enlarged front perspective view of the example knuckle pin shown in FIGS. 2 and 3.
Figure 5:
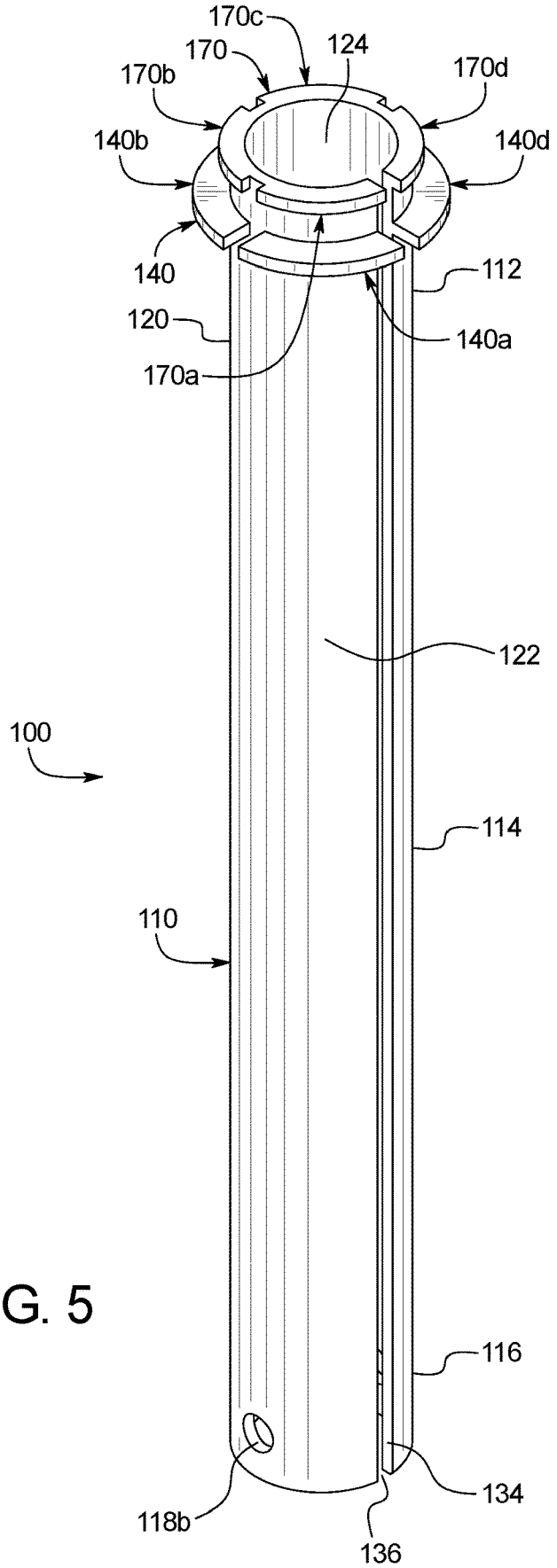
FIG. 5 is a second enlarged front perspective view of the knuckle pin of FIG. 4.
Figure 6:
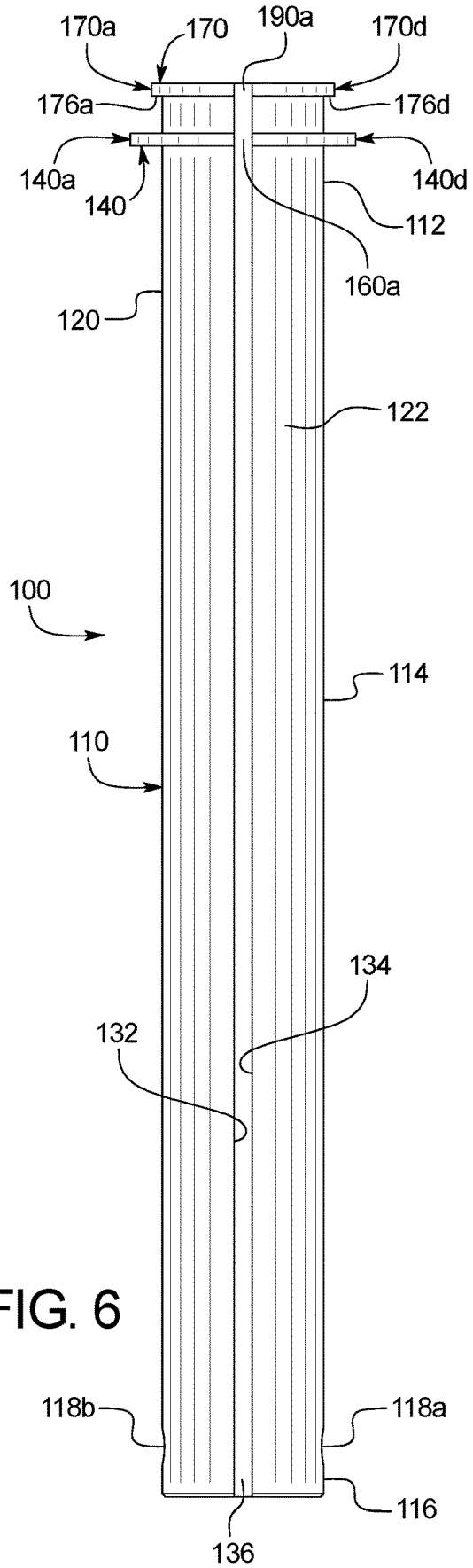
FIG. 6 is an enlarged front view of the knuckle pin of FIG. 4.
Figure 7:
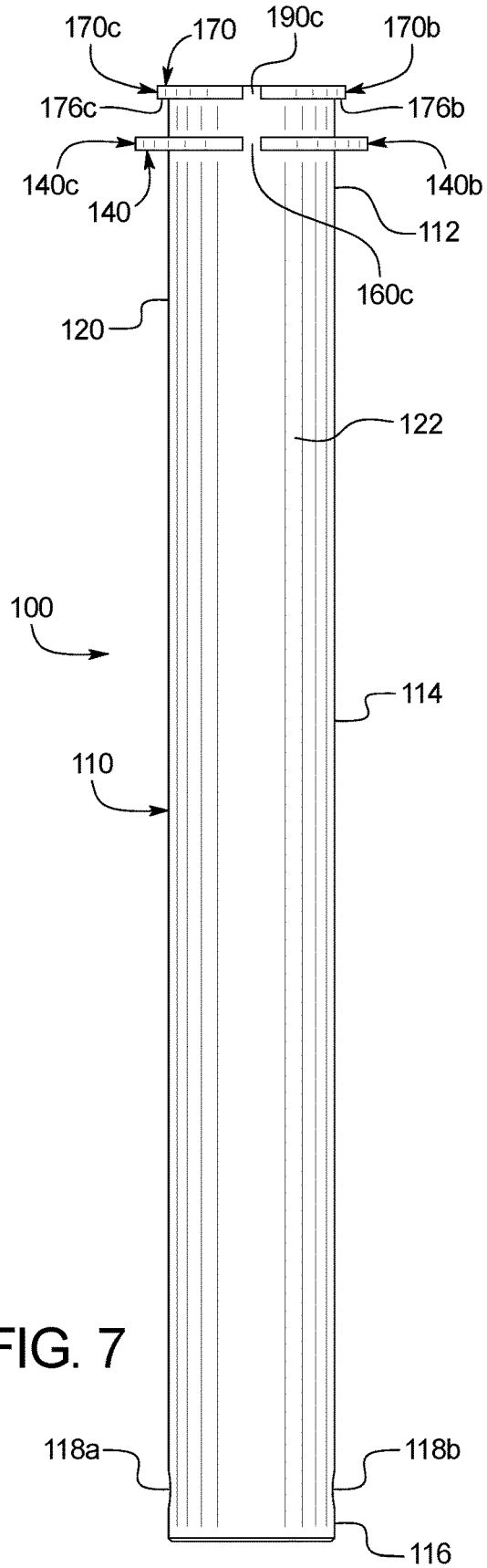
FIG. 7 is an enlarged rear view of the knuckle pin of FIG. 4.
Figure 8:
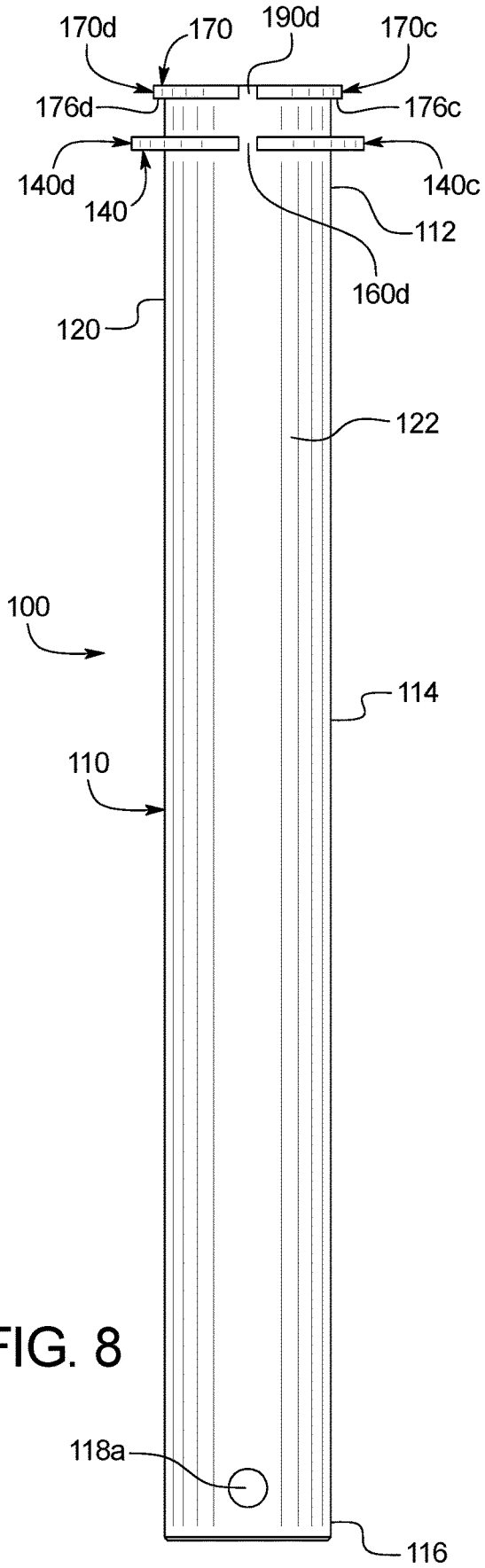
FIG. 8 is an enlarged right side view of the knuckle pin of FIG. 4.
Figure 9:
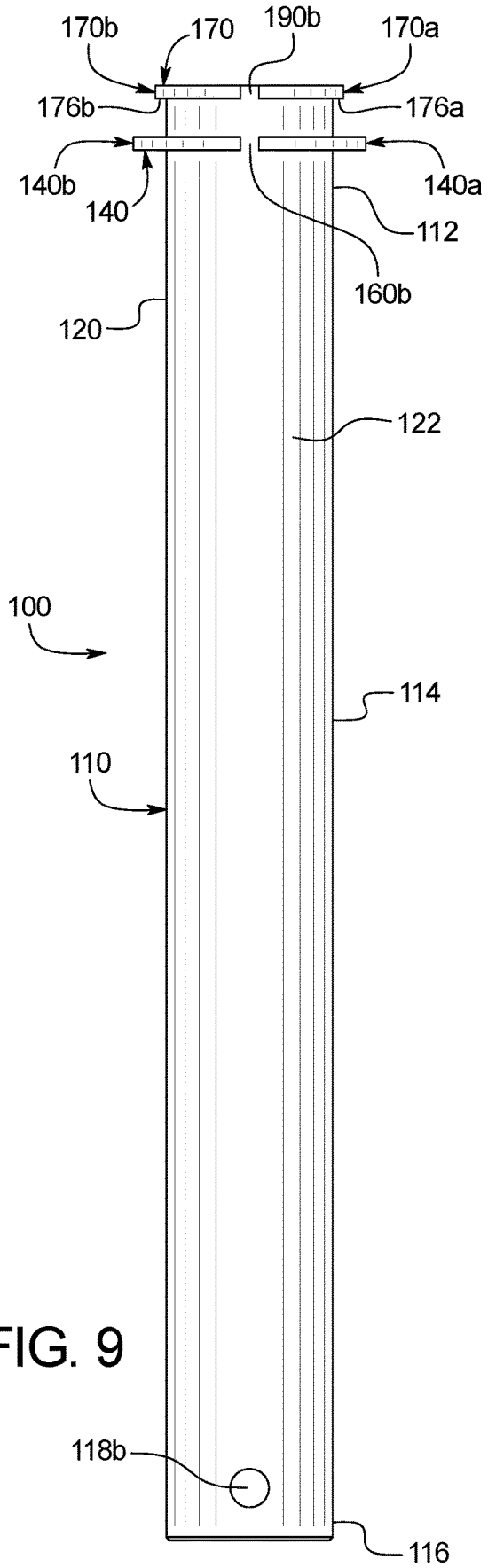
FIG. 9 is an enlarged left side view of the knuckle pin of FIG. 4.
Figure 10:
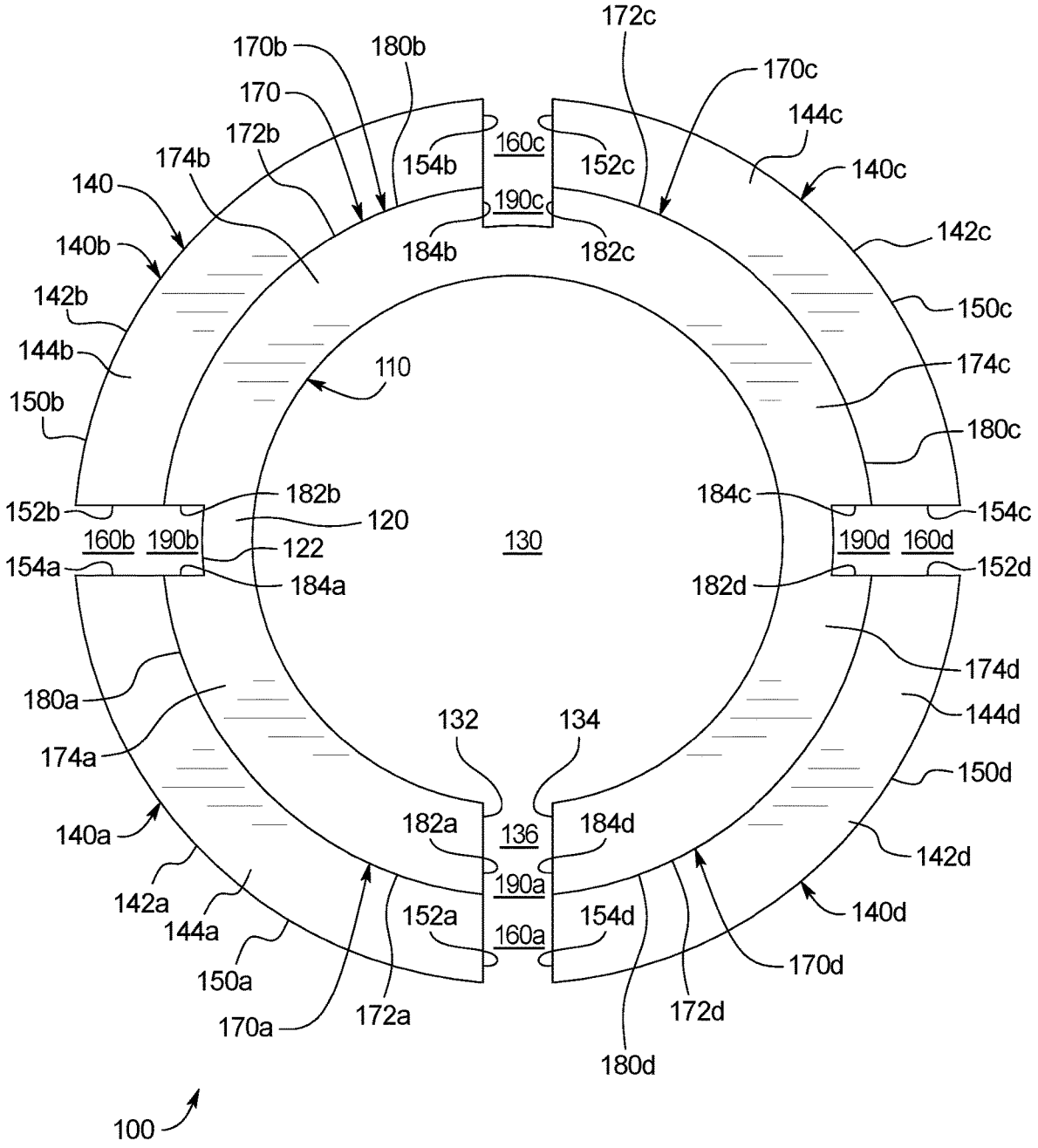
FIG. 10 is an even further enlarged top end view of the knuckle pin of FIG. 4.
Figure 11:
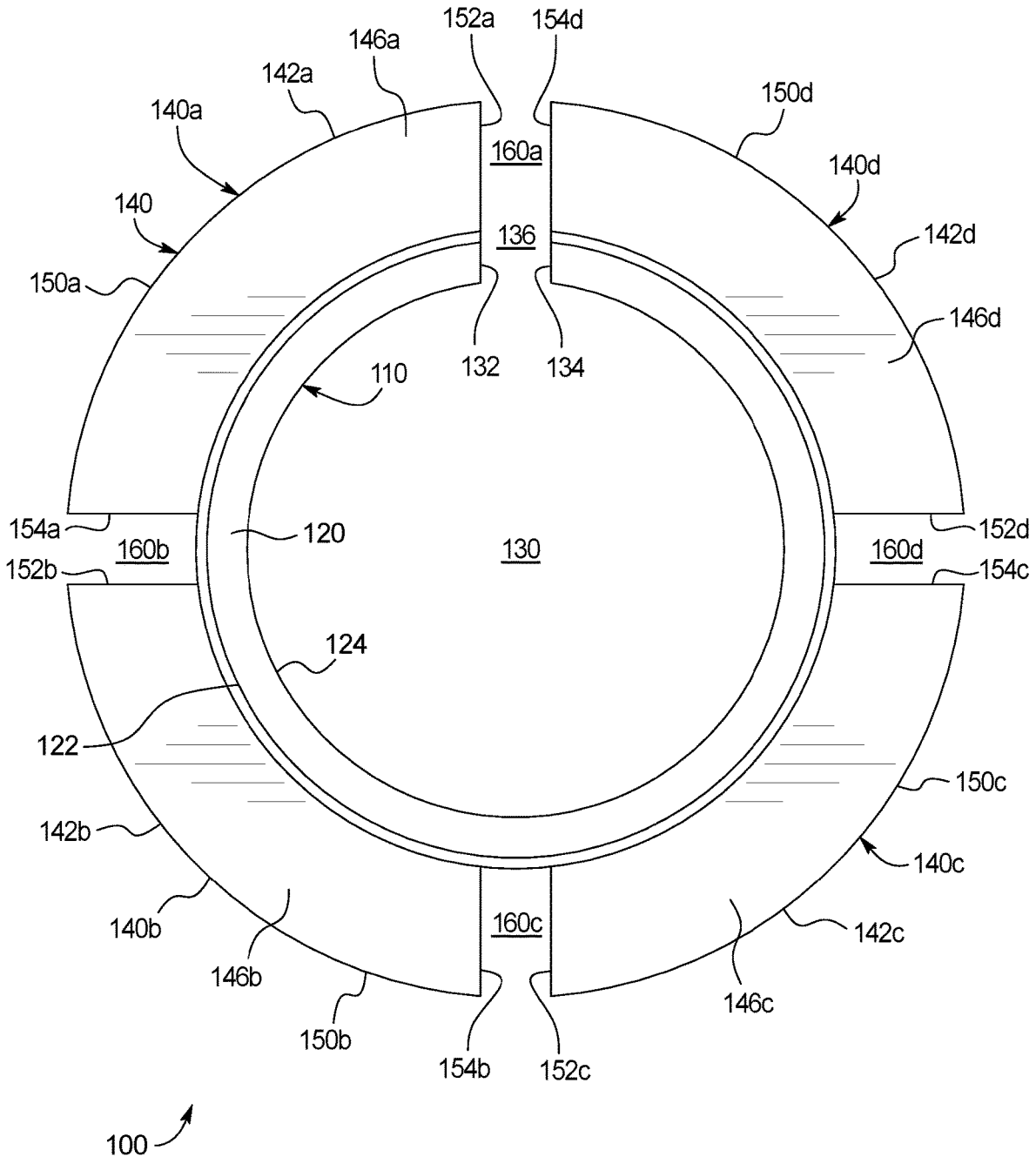
FIG. 11 is an even further enlarged bottom end view of the knuckle pin of FIG. 4.
Figure 12:
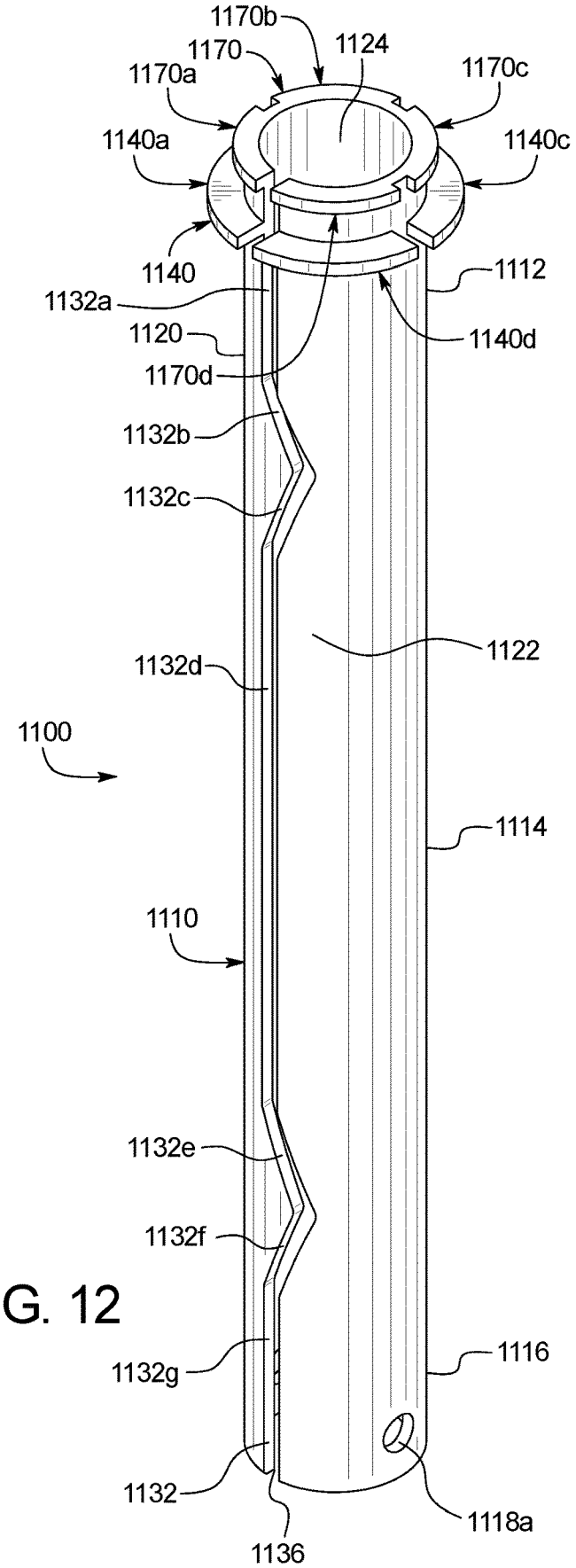
FIG. 12 is a first enlarged front perspective view of another example embodiment of a knuckle pin of the present disclosure.
Figure 13:
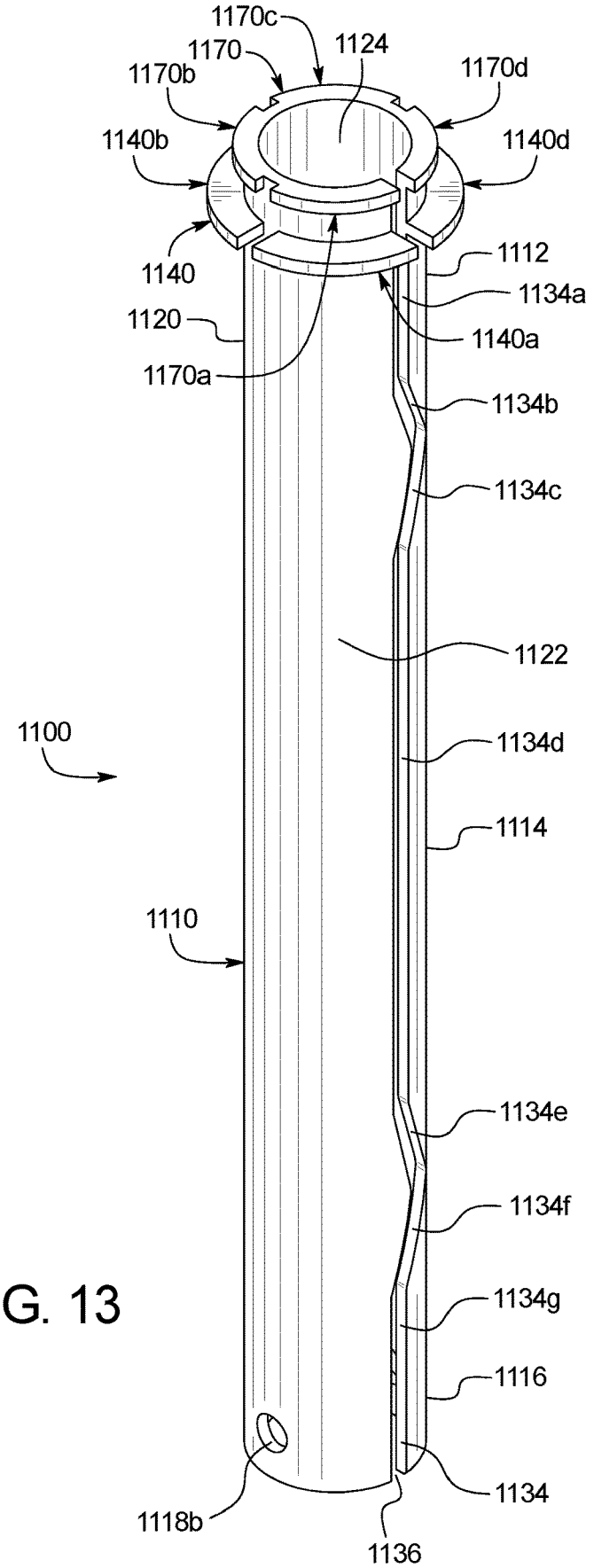
FIG. 13 is a second enlarged front perspective view of the knuckle pin of FIG. 12.
Figure 14:
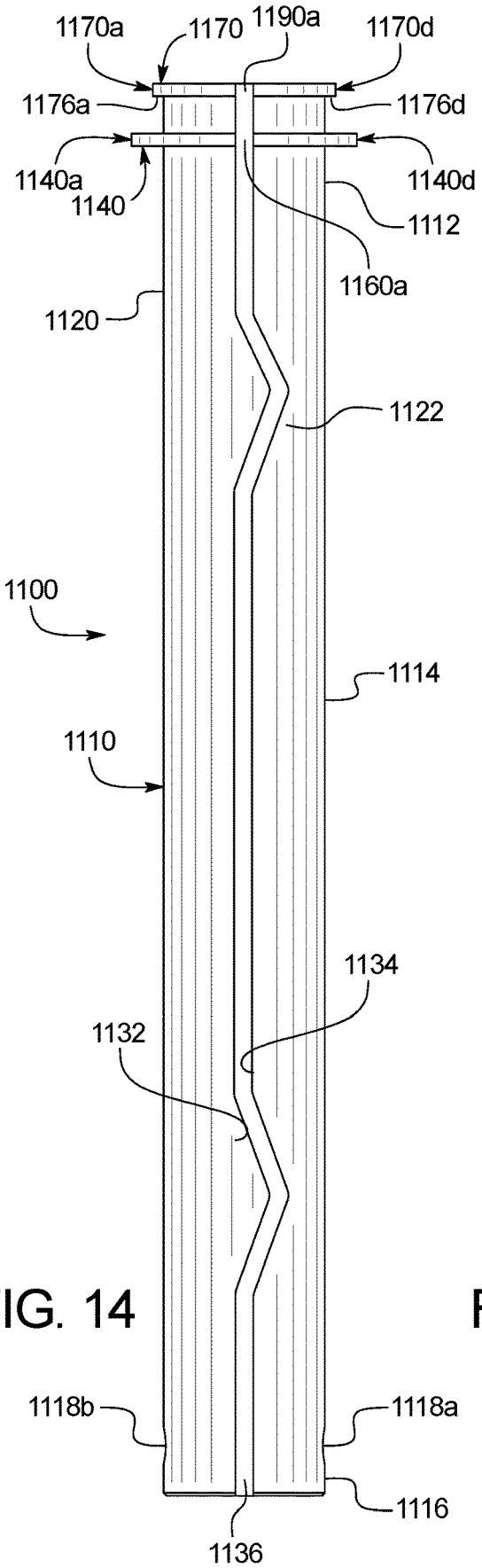
FIG. 14 is an enlarged front view of the knuckle pin of FIG. 12.
Figure 15:
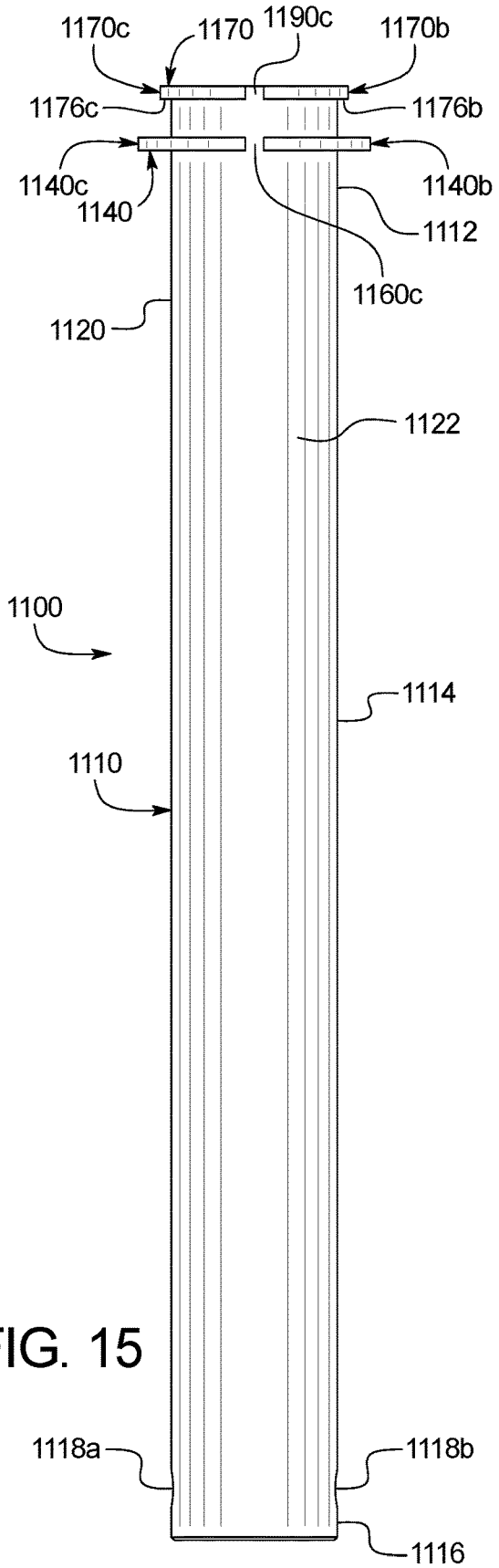
FIG. 15 is an enlarged rear view of the knuckle pin of FIG. 12.
Figure 16:
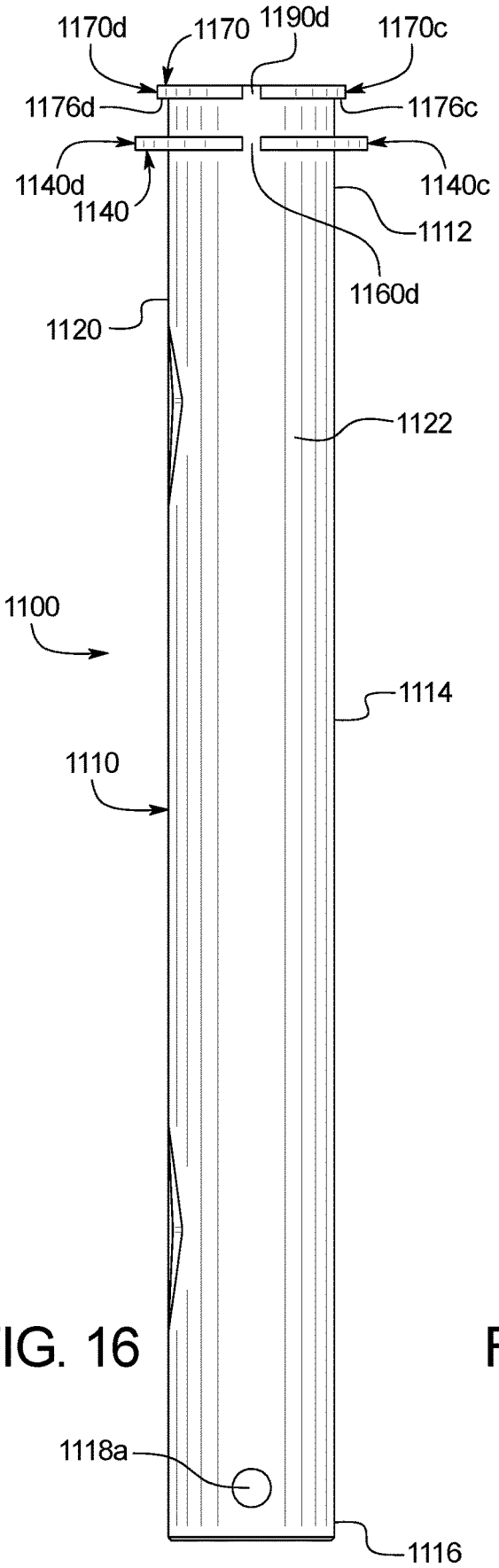
FIG. 16 is an enlarged right side view of the knuckle pin of FIG. 12.
Figure 17:
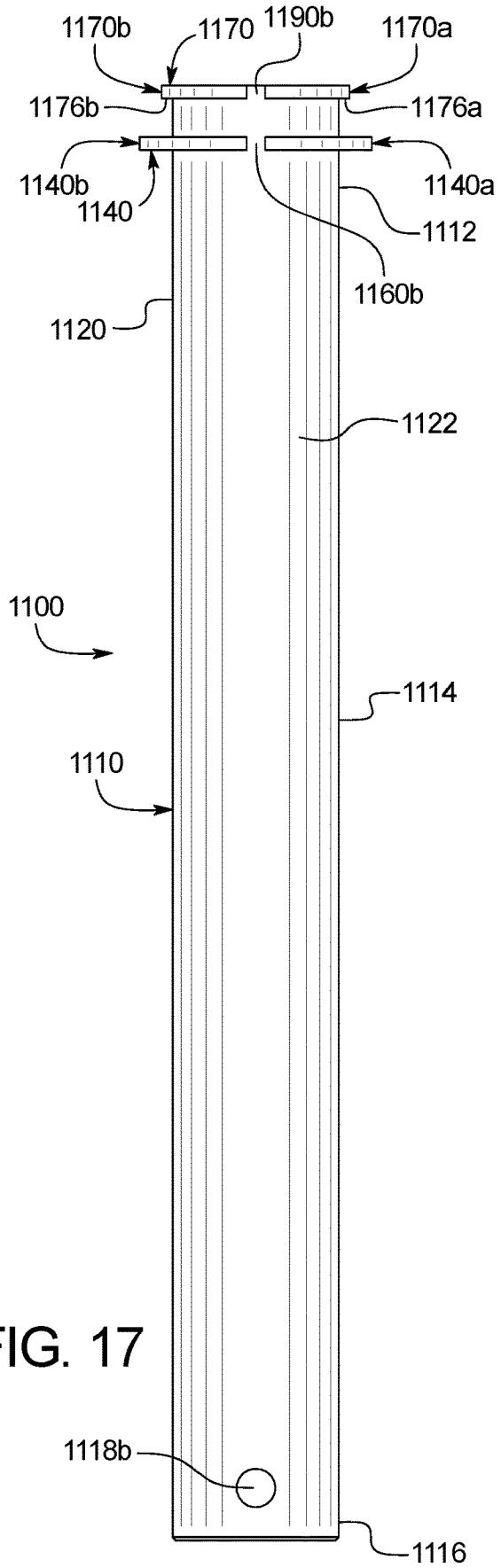
FIG. 17 is an enlarged left side view of the knuckle pin of FIG. 12.
Figure 18:
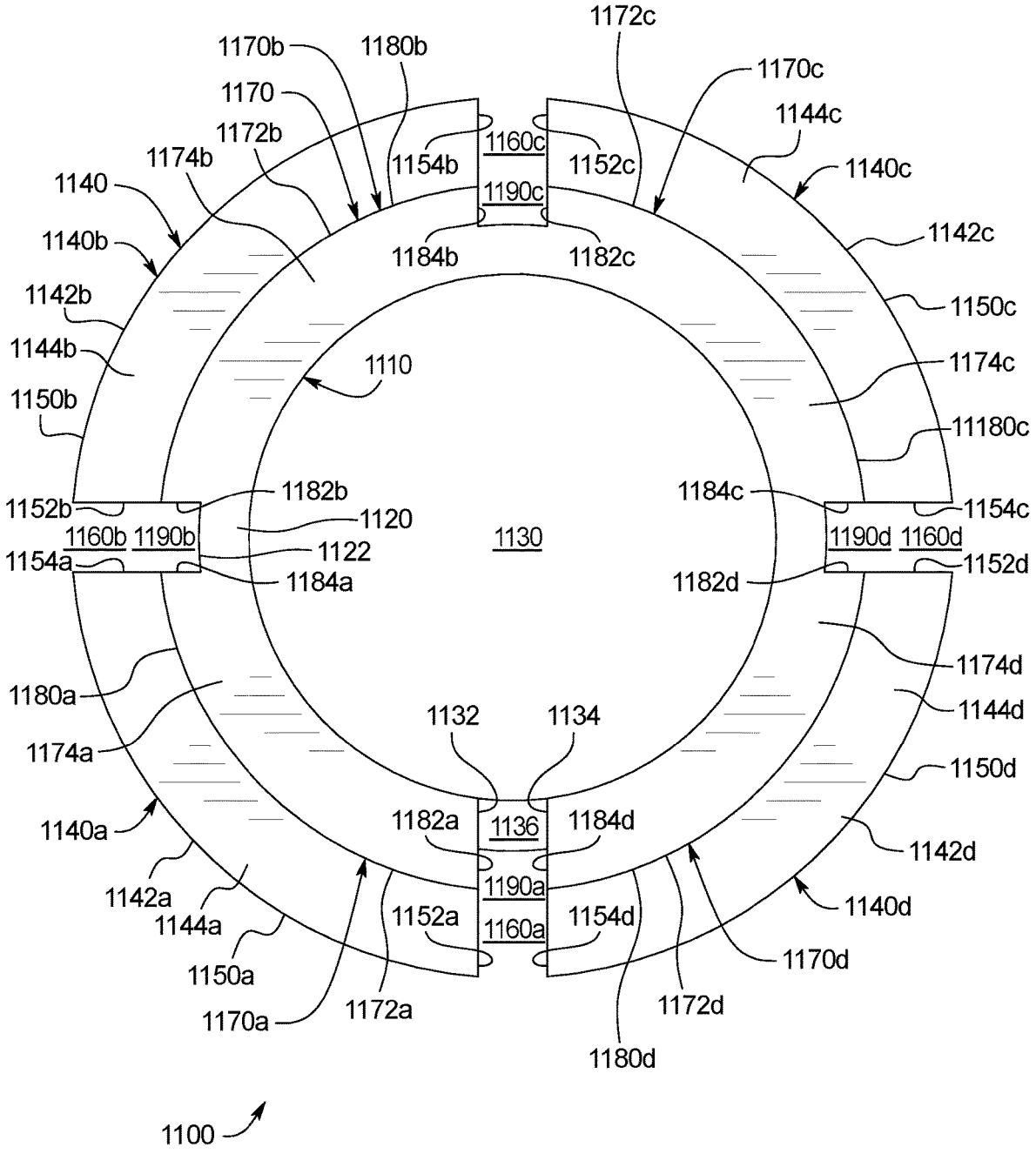
FIG. 18 is an even further enlarged top end view of the knuckle pin of FIG. 12.
Figure 19:
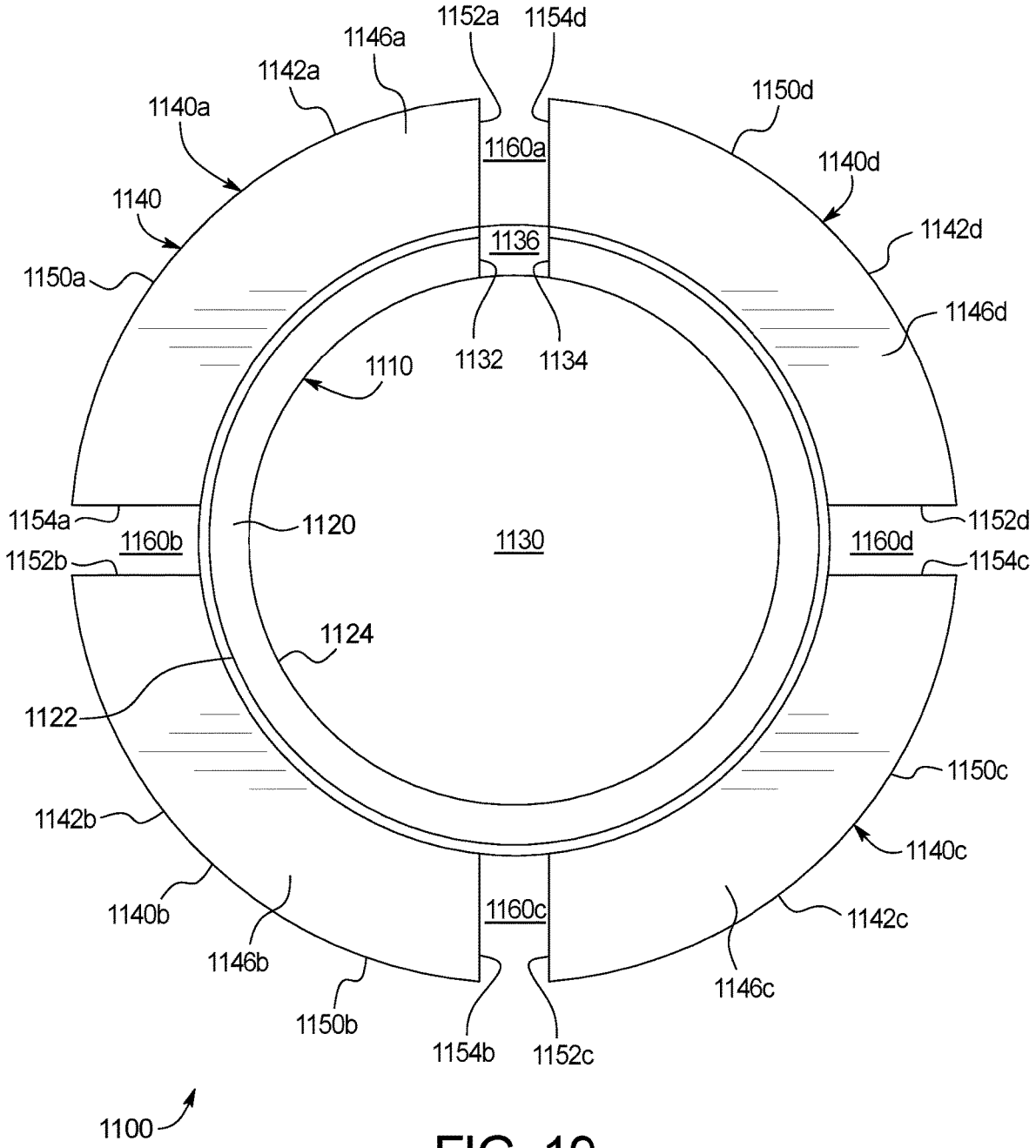
FIG. 19 is an even further enlarged bottom end view of the knuckle pin of FIG. 12.

FIGS. 2 and 3 generally illustrate one example embodiment of adjacent coupler assemblies 40 and 70 and two uses of a knuckle pin of one example embodiment of the present disclosure, generally indicated by numeral 100. In this illustrated example embodiment, the example knuckle pin 100 is configured to pivotally attach a knuckle (such as knuckle 42) of the coupler assembly 40 to a coupler (such as coupler 44) of the coupler assembly 40. In this illustrated example embodiment, the example knuckle pin 100 is rotatably positioned in the knuckle and the coupler of the coupler assembly 40. FIGS. 4 to 11 further illustrate the example knuckle pin 100 of the present disclosure that is configured to pivotally attach a knuckle of a coupler assembly to a coupler of a coupler assembly of a railroad car.

This example knuckle pin 100 includes an elongated generally cylindrical tubular body 110 having a first (or upper) end portion 112, a second (or lower) end portion 116 spaced apart from the first end portion 112, and an intermediate portion 114 between and connecting the first end portion 112 and the second end portion 116. The body 110 includes an elongated generally cylindrical wall 120 that has a generally cylindrical outer surface 122 and a generally cylindrical inner surface 124. The inner surface 124 defines an elongated generally cylindrical central opening 130 that extends the entire length of the body 110. The generally cylindrical wall 120 further includes two spaced apart elongated opposing surfaces 132 and 134 that define an elongated slot 136 that extends the entire length of the wall 120 and thus the entire length of the body 110. These surfaces 132 and 134 can extend in intersecting planes, can extend in parallel planes, can be angled, can be curved, or can be otherwise suitably formed.

The second end portion 116 of the body 120 of the knuckle pin 100 defines a plurality of spaced apart aligned fastener receipt holes (such as cotter pin receipt holes 118*a* and 118*b*) that enable a suitable fastener (such as a cotter pin (not labeled but shown in phantom in FIG. 3)) to be employed to lock the knuckle pin 100 in place in the knuckle and coupler of the coupler assembly. It should be appreciated that other suitable locking devices can be employed in accordance with the present disclosure. It should also be appreciated that other mechanism can be employed for securing the knuckle pin 100 in position.

This example knuckle pin 100 further includes a first generally annular ring 140 integrally connected to and outwardly extending from a first area of the first end portion 112 of the body 110, and a second generally annular ring 170 integrally connected to and outwardly extending from a second area of the first end portion 112 of the body 110. The second ring 170 is spaced apart from the first ring 140 along the body 110.

The first ring 140 includes four equally sized sections 140*a*, 140*b*, 140*c*, and 140*d* that make up or form the ring 140. Each section 140*a*, 140*b*, 140*c*, and 140*d* includes a curved wall having a top surface, a bottom surface, a concave inner surface (integrally connected to the outer surface 122 of the wall 120 of the body 110), a convex outer surface, a first end surface, and a second end surface. More specifically, section 140*a* includes a curved wall 142*a* having a top surface 144*a*, a bottom surface 146*a*, a concave inner surface (not labeled and integrally connected to the outer surface 122 of the wall 120 of the body 110), a convex outer surface 1506*a*, a first end surface 152*a*, and a second end surface 154*a*. Likewise, section 140*b* includes a curved wall 142*b* having a top surface 144*b*, a bottom surface 146*b*, a concave inner surface (not labeled and integrally connected to the outer surface 122 of the wall 120 of the body 110), a convex outer surface 150*b*, a first end surface 152*b*, and a second end surface 154*b*. Likewise, section 140*c* includes a curved wall 142*c* having a top surface 144*c*, a bottom surface 146*c*, a concave inner surface (not labeled and integrally connected to the outer surface 122 of the wall 120 of the body 110), a convex outer surface 150*c*, a first end surface 152*c*, and a second end surface 154*c*. Likewise, section 140*d* includes a curved wall 142*d* having a top surface 144*d*, a bottom surface 146*d*, a concave inner surface (not labeled and integrally connected to the outer surface 122 of the wall 120 of the body 110), a convex outer surface 150*d*, a first end surface 152*d*, and a second end surface 154*d*.

The first end surface 152*a* and the second end surface 154*d* define a first stress relief slot 160*a*. The first end surface 152*b* and the second end surface 154*a* define a second stress relief slot 160*b*. The first end surface 152*c* and the second end surface 154*b* define a third stress relief slot 160*c*. The first end surface 152*d* and the second end surface 154*c* define a fourth stress relief slot 160*c*. The first ring 140 thus defines four spaced apart symmetrically arranged stress relief slots 160*a*, 160*b*, 160*c*, and 160*d*. These stress relief slots 160*a*, 160*b*, 160*c*, and 160*d* co-act to relieve stress in the first ring 140 and in the body 110 when bending forces are exerted on the knuckle pin 100 by the knuckle and/or the coupler. The stress relief slots 160*a*, 160*b*, 160*c*, and 160*d* enable the material of the first ring and body to work or bend more without breaking while promoting the ability for elastic radial displacement of the knuckle pin body 110. In other words, these stress relief slots 160*a*, 160*b*, 160*c*, and 160*d* provide suitable compression paths for dispersing forces. These stress relief slots 160*a*, 160*b*, 160*c*, and 160*d* also reduce the overall weight of the knuckle pin 100. The respective surfaces that define each of these stress relief slots can extend in intersecting planes, can extend in parallel planes, can be angled, can be curved, or can be otherwise suitably formed in accordance with the present disclosure.

The first ring 140 is sized diametrically larger than coupler and knuckle openings for knuckle pin placement (not shown) in a coupler to prevent the knuckle pin 100 from falling through the knuckle pin opening in the coupler.

The second ring 170 also includes four equally sized sections 170*a*, 170*b*, 170*c*, and 170*d* that make up or form the ring 170. Each section 170*a*, 170*b*, 170*c*, and 170*d* includes a curved wall having a top surface, a bottom surface, a concave inner surface (integrally connected to the outer surface 122 of the wall 120 of the body 110), a convex outer surface, a first end surface, and a second end surface. More specifically, section 170*a* includes a curved wall 172*a* having a top surface 174*a*, a bottom surface 176*a*, a concave inner surface (not labeled and integrally connected to the outer surface 122 of the wall 120 of the body 110), a convex outer surface 180*a*, a first end surface 182*a*, and a second end surface 184*a*. Likewise, section 170*b* includes a curved wall 172*b* having a top surface 174*b*, a bottom surface 176*b*, a concave inner surface (not labeled and integrally connected to the outer surface 122 of the wall 120 of the body 110), a convex outer surface 180*b*, a first end surface 182*b*, and a second end surface 184*b*. Likewise, section 170*c* includes a curved wall 172*c* having a top surface 174*c*, a bottom surface 176*c*, a concave inner surface (not labeled and integrally connected to the outer surface 122 of the wall 120 of the body 110), a convex outer surface 180*c*, a first end surface 182*c*, and a second end surface 184*c*. Likewise, section 170*d* includes a curved wall 172*d* having a top surface 174*d*, a bottom surface 176*d*, a concave inner surface (not labeled and integrally connected to the outer surface 122 of the wall 120 of the body 110), a convex outer surface 180*d*, a first end surface 182*d*, and a second end surface 184*d*.

The first end surface 182*a* and the second end surface 184*d* define a first stress relief slot 190*a*. The first end surface 182*b* and the second end surface 184*a* define a second stress relief slot 190*b*. The first end surface 182*c* and the second end surface 184*b* define a third stress relief slot 190*c*. The first end surface 182*d* and the second end surface 184*c* define a fourth stress relief slot 190*d*. The second ring 170 thus defines four spaced apart symmetrically arranged stress relief slots 190*a*, 190*b*, 190*c*, and 190*d*. These stress relief slots 190*a*, 190*b*, 190*c*, and 190*d* co-act to relieve stress in the second ring 170 and in the body 110 when bending forces are exerted on the knuckle pin 100 by the knuckle and/or the coupler. The stress relief slots 190*a*, 190*b*, 190*c*, and 190*d* enable the material of the second ring and body to work or bend more without breaking. In other words, these stress relief slots 190*a*, 190*b*, 190*c*, and 190*d* provide suitable compression paths for dispensing forces. These stress relief slots 190*a*, 190*b*, 190*c*, and 190*d* also reduce the overall weight of the knuckle pin 100. The respective surfaces that define each of these stress relief slots can extend in intersecting planes, can extend in parallel planes, can be angled, can be curved, or can be otherwise suitably formed in accordance with the present disclosure.

In this illustrated example embodiment, the stress relief slots 190*a*, 190*b*, 190*c*, and 190*d* of the second ring 170 are respectively aligned with the stress relief slots 160*a*, 160*b*, 160*c*, and 160*d* of the first ring 140. It should be appreciated that two or more of the respective stress relief slots of the first and second rings are not aligned in accordance with the present disclosure.

The second ring 170 is sized diametrically larger than a knuckle pin opening in a coupler. If the first ring 140 breaks off of the wall 120, the second ring 170 prevents the knuckle pin 100 from falling through the knuckle pin opening in the coupler. The second ring 170 is spaced above the top of the coupler when the knuckle pin 100 is positioned in the coupler and knuckle as generally shown in FIG. 3. Thus, the second ring 170 and the area of the body 110 between the first ring 140 and the second ring 170 provide a removal head that enables a person to grip the knuckle pin 100 and remove the knuckle pin 100 from the coupler and the knuckle for inspection, repair, replacement, or other purposes.

This illustrated example knuckle pin 100 is a monolithically formed steel member. In this example, the first ring 140 is welded to the outer surface 122 of the wall 120 of the body 110. Likewise, in this example, the second ring 170 is welded to the outer surface 122 of the wall 120 of the body 110. It should be appreciated that these components can be otherwise formed in accordance with the present disclosure.

It should further be appreciated that the wall 120 of the body 110, the first ring 140, and the second ring 170 are configured and formed to co-act to provide a desired approximately of flexibility to enable the knuckle pin 100 to absorb significant bending forces placed on the knuckle pin 100 by a knuckle and/or coupler while minimizing fatigue, thereby substantially reducing the likelihood of failure of the knuckle pin 100.

In this illustrated example embodiment, the wall 120 of the body 110 of the knuckle pin 100 has a length or height of approximately 340 millimeters (approximately 13 to 14 inches, and preferably 13.375 inches). In this illustrated example embodiment, the wall of the body has a thickness of approximately 3 millimeters (approximately 0.05 to 0.25 inches, and preferably 0.125 inches). In this illustrated example embodiment, the wall 120 of the body 110 has an outer diameter of approximately 41 millimeters (approximately 1.4 to 1.6 inches, and preferably 1.6 inches). In this illustrated example embodiment, the wall of the body has an inner diameter of approximately 34 millimeters (approximately 1.35 inches). In this illustrated embodiment, the longitudinal slot in the body has a width of approximately 5 millimeters (approximately 0.1 to 0.2 inches, preferably 0.1875 inches).

In this illustrated example embodiment, the first ring has a thickness of approximately 3 millimeters (approximately 0.125 inches). In this illustrated example embodiment, the first ring 140 has an outer diameter of approximately 57 millimeters (approximately 2.25 inches). In this illustrated example embodiment, the first ring has an inner diameter of approximately 41 millimeters (approximately 1.6 inches). In this illustrated example embodiment, the first ring has a depth of approximately 8.40 millimeters (approximately 0.33 inches). In this illustrated embodiment, the stress relief slots in the first ring each have a width of approximately 5 millimeters (approximately 0.1875 inches).

In this illustrated example embodiment, the second ring has a thickness of approximately 3 millimeters (approximately 0.125 inches). In this illustrated example embodiment, the second ring has an outer diameter of approximately 46 millimeters (approximately 1.8 inches). In this illustrated example embodiment, the second ring 170 has an inner diameter of approximately 41 millimeters (approximately 1.6 inches). In this illustrated example embodiment, the second ring has a depth of approximately 2.50 millimeters (approximately 0.10 inches). In this illustrated embodiment, the stress relief slots in the second ring each have a width of approximately 5 millimeters (approximately 0.1825 inches).

In this illustrated embodiment, the knuckle pin 100 weighs approximately 1 kilogram (approximately 2.2 pounds).

For reinforcement purposes, one or more annular beads (not shown) may be formed at the bases of one or more of the rings 140 and/or 170 and the wall 120 to provide additional attachment strength of the rings 140 and 170 to the wall 120.

FIGS. 12, 13, 14, 15, 16, 17, 18, and 19 illustrate another example embodiment of a knuckle pin of the present disclosure, generally indicated by numeral 1100. In this illustrated example embodiment, the example knuckle pin 1100 is also configured to pivotally attach a knuckle to a coupler of a coupler assembly.

This knuckle pin 1100 is identical to the example knuckle pin 100 described above except in the wall 1120 that defines body 1110, and specifically except in the two spaced apart elongated opposing surfaces 1132 and 1134 that define the elongated slot 1136 are non-linear.

Thus, like knuckle pin 100, knuckle pin 1100 includes an elongated generally cylindrical tubular body 1110 having a first (or upper) end portion 1112, a second (or lower) end portion 1116 spaced apart from the first end portion 1112, and an intermediate portion 1114 between and connecting the first end portion 1112 and the second end portion 1116. The body 1110 includes an elongated generally cylindrical wall 1120 that has a generally cylindrical outer surface 1122 and a generally cylindrical inner surface 1124. The inner surface 1124 defines an elongated generally cylindrical central opening 1130 that extends the entire length of the body 1110. The generally cylindrical wall 1120 further includes two spaced apart elongated opposing surfaces 1132 and 1134 that define an elongated slot 1136 that extends the entire length of the wall 1120 and thus the entire length of the body 1110.

These opposing surfaces 1132 and 1134 are non-linear. More specifically, surface 1132 includes: (1) a first portion 1132*a*; (2) a second portion 1132*b*; (3) a third portion 1132*c*;

(4) a fourth portion 1132*d*; (5) a fifth portion 1132*e*; (6) a sixth portion 1132*f*; and (7) a seventh portion 1132*g*. Likewise, surface 1134 includes: (1) a first portion 1134*a*; (2) a second portion 1134*b*; (3) a third portion 1134*c*; (4) a fourth portion 1134*d*; (5) a fifth portion 1134*e*; (6) a sixth portion 1134*f*; and (7) a seventh portion 1134*g*. In this example embodiment, (1) the first portion 1132*a* opposes the first portion 1134*a*; (2) the second portion 1132*b* opposes the second portion 1134*b*; (3) the third portion 1132*c* opposes the third portion 1134*c*; (4) the fourth portion 1132*d* opposes the fourth portion 1134*d*; (5) the fifth portion 1132*e* opposes the fifth portion 1134*e*; (6) the sixth portion 1132*f* opposes the sixth portion 1134*f*; and (7) the seventh portion 1132*g* opposes the seventh portion 1134*g*. It should be appreciated that these respective surfaces 1132 and 1134 and specifically the respective portions for somewhat of a zig-zag type pattern to the elongated slot 1166. It should be appreciated that the quantity of offset or angled sections may vary in accordance with the present disclosure. It should also be appreciated that in other suitable embodiments, the opposing surfaces can be curved (i.e., can have one or more curves that define the non-linear configuration).

This non-linear configuration provides additional structural rigidity to the wall 1120, the body 1110, and the entire knuckle pin 1100. This configuration non-linear configuration additionally reduces the amount of wear on the surfaces that define the slot 1136 and the outer edges of those surfaces. More specifically, if the rotatable knuckle pin 1100 has rotated to a position where a part of the body 1110 extends against an inner bearing surface of the knuckle or coupler, there is little to no wear on the surfaces that define the slot 1136 and the outer edges of those surfaces. On the other hand, if the rotatable knuckle pin 1100 has rotated to a position where the surfaces that define the slot 1136 and the outer edges of those surfaces are against an inner bearing surface of the of the knuckle or coupler, those surfaces and edges can be subjected to wearing forces that can eventually reduce the deformation characteristics of the knuckle pin 1100. The non-linear configuration minimizes the amount of wear on the surfaces that define the slot 1136 and the outer edges of those surfaces because at any one position that the knuckle pin has rotated to, only certain of the surfaces that define the slot 1136 and the outer edges of those surfaces will be in engagement with the inner bearing surfaces of the knuckle or coupler. Additionally, the non-linear configuration minimizes the amount of wear on the surfaces that define the slot 1136 and the outer edges of those surfaces because at any one position that the knuckle pin has rotated to, certain non-interrupted and that stronger portions of the outer surface of the wall 1120 of the body 1110 will be in engagement with the inner bearing surfaces of the knuckle or coupler.

Like knuckle pin 100, the second end portion 1116 of the body 1120 of the knuckle pin 1100 defines a plurality of spaced apart aligned fastener receipt holes (such as cotter pin receipt holes 1118*a* and 1118*b*) that enable a suitable fastener (such as a cotter pin (not shown)) to be employed to lock the knuckle pin 1100 in place in the knuckle and coupler of the coupler assembly. It should be appreciated that other suitable locking devices can be employed in accordance with the present disclosure. It should also be appreciated that other mechanism can be employed for securing the knuckle pin 1100 in position.

Like knuckle pin 100, this example knuckle pin 1100 further includes a first generally annular ring 1140 integrally connected to and outwardly extending from a first area of the first end portion 1112 of the body 1110, and a second generally annular ring 1170 integrally connected to and outwardly extending from a second area of the first end portion 1112 of the body 1110. The second ring 1170 is spaced apart from the first ring 1140 along the body 1110.

Like with knuckle pin 100, the first ring 1140 includes four equally sized sections 1140*a*, 1140*b*, 1140*c*, and 1140*d* that make up or form the ring 1140. Each section 1140*a*, 1140*b*, 1140*c*, and 1140*d* includes a curved wall having a top surface, a bottom surface, a concave inner surface (integrally connected to the outer surface 1122 of the wall 1120 of the body 1110), a convex outer surface, a first end surface, and a second end surface. More specifically, section 1140*a* includes a curved wall 1142*a* having a top surface 1144*a*, a bottom surface 1146*a*, a concave inner surface (not labeled and integrally connected to the outer surface 1122 of the wall 1120 of the body 1110), a convex outer surface 1150*a*, a first end surface 1152*a*, and a second end surface 1154*a*. Likewise, section 1140*b* includes a curved wall 1142*b* having a top surface 1144*b*, a bottom surface 1146*b*, a concave inner surface (not labeled and integrally connected to the outer surface 1122 of the wall 1120 of the body 1110), a convex outer surface 1150*b*, a first end surface 1152*b*, and a second end surface 1154*b*. Likewise, section 1140*c* includes a curved wall 1142*c* having a top surface 1144*c*, a bottom surface 1146*c*, a concave inner surface (not labeled and integrally connected to the outer surface 1122 of the wall 1120 of the body 1110), a convex outer surface 1150*c*, a first end surface 1152*c*, and a second end surface 1154*c*. Likewise, section 1140*d* includes a curved wall 1142*d* having a top surface 1144*d*, a bottom surface 1146*d*, a concave inner surface (not labeled and integrally connected to the outer surface 1122 of the wall 1120 of the body 1110), a convex outer surface 1150*d*, a first end surface 1152*d*, and a second end surface 1154*d*.

Like with knuckle pin 100, the first end surface 1152*a* and the second end surface 1154*d* define a first stress relief slot 1160*a*. The first end surface 1152*b* and the second end surface 1154*a* define a second stress relief slot 1160*b*. The first end surface 1152*c* and the second end surface 1154*b* define a third stress relief slot 1160*d*. The first end surface 1162*d* and the second end surface 1164*c* define a fourth stress relief slot 1160*d*. The first ring 1140 thus defines four spaced apart symmetrically arranged stress relief slots 1160*a*, 1160*b*, 1160*c*, and 1160*d*. These stress relief slots 1160*a*, 1160*b*, 1160*c*, and 1160*d* co-act to relieve stress in the first ring 1140 and in the body 1110 when bending forces are exerted on the knuckle pin 1100 by the knuckle and/or the coupler. The stress relief slots 1160*a*, 1160*b*, 1160*c*, and 1160*d* enable the material of the first ring and body to work or bend more without breaking. In other words, these stress relief slots 1160*a*, 1160*b*, 1160*c*, and 1160*d* provide suitable compression paths for dispersing forces while promoting the ability for elastic radial displacement of the body 1110. These stress relief slots 1160*a*, 1160*b*, 1160*c*, and 1160*d* also reduce the overall weight of the knuckle pin 1100. The respective surfaces that define each of these stress relief slots can extend in intersecting planes, can extend in parallel planes, can be angled, can be curved, or can be otherwise suitably formed in accordance with the present disclosure.

Like with knuckle pin 100, the first ring 1140 is sized diametrically larger than a knuckle pin opening (not shown) in a coupler to prevent the knuckle pin 1100 from falling through the knuckle pin opening in the coupler.

Like with knuckle pin 100, the second ring 1170 also includes four equally sized sections 1170*a*, 1170*b*, 1170*c*, and 1170*d* that make up or form the ring 1170. Each section 1170*a*, 1170*b*, 1170*c*, and 1170*d* includes a curved wall having a top surface, a bottom surface, a concave inner surface (integrally connected to the outer surface 11122 of the wall 120 of the body 1110), a convex outer surface, a first end surface, and a second end surface. More specifically, section 1170*a* includes a curved wall 1172*a* having a top surface 1174*a*, a bottom surface 1176*a*, a concave inner surface (not labeled and integrally connected to the outer surface 1122 of the wall 1120 of the body 1110), a convex outer surface 1180*a*, a first end surface 1182*a*, and a second end surface 1184*a*. Likewise, section 1170*b* includes a curved wall 1172*b* having a top surface 1174*b*, a bottom surface 1176*b*, a concave inner surface (not labeled and integrally connected to the outer surface 1122 of the wall 1120 of the body 110), a convex outer surface 1180*b*, a first end surface 1182*b*, and a second end surface 1184*b*. Likewise, section 1170*c* includes a curved wall 1172*c* having a top surface 1174*c*, a bottom surface 1176*c*, a concave inner surface (not labeled and integrally connected to the outer surface 1122 of the wall 1120 of the body 1110), a convex outer surface 1180*c*, a first end surface 1182*c*, and a second end surface 1184*c*. Likewise, section 1170*d* includes a curved wall 1172*d* having a top surface 1174*d*, a bottom surface 1176*d*, a concave inner surface (not labeled and integrally connected to the outer surface 1122 of the wall 1120 of the body 1110), a convex outer surface 1180*d*, a first end surface 1182*d*, and a second end surface 1184*d*.

Like with knuckle pin 100, the first end surface 1182*a* and the second end surface 1184*d* define a first stress relief slot 1190*a*. The first end surface 182*b* and the second end surface 1184*a* define a second stress relief slot 1190*a*. The first end surface 1182*c* and the second end surface 1184*b* define a third stress relief slot 1190*c*. The first end surface 1182*d* and the second end surface 1184*c* define a fourth stress relief slot 1190*a*. The second ring 1170 thus defines four spaced apart symmetrically arranged stress relief slots 1190*a*, 1190*b*, 1190*c*, and 1190*d*. These stress relief slots 1190*a*, 1190*b*, 1190*c*, and 1190*d* co-act to relieve stress in the second ring 1170 and in the body 1110 when bending forces are exerted on the knuckle pin 1100 by the knuckle and/or the coupler. The stress relief slots 1190*a*, 1190*b*, 1190*c*, and 1190*d* enable the material of the second ring and body to work or bend more without breaking. In other words, these stress relief slots 1190*a*, 1190*b*, 1190*c*, and 1190*d* provide suitable compression paths for dispensing forces. These stress relief slots 1190*a*, 1190*b*, 1190*c*, and 1190*d* also reduce the overall weight of the knuckle pin 1100. The respective surfaces that define each of these stress relief slots can extend in intersecting planes, can extend in parallel planes, can be angled, can be curved, or can be otherwise suitably formed in accordance with the present disclosure.

In this illustrated example embodiment, the stress relief slots 1190*a*, 1190*b*, 1190*c*, and 1190*d* of the second ring 1170 are respectively aligned with the stress relief slots 1160*a*, 1160*b*, 1160*c*, and 1160*d* of the first ring 1140. It should be appreciated that two or more of the respective stress relief slots of the first and second rings are not aligned in accordance with the present disclosure.

Like with knuckle pin 100, the second ring 1170 is sized diametrically larger than a knuckle pin opening in a coupler. If the first ring 1140 breaks off of the wall 1120, the second ring 1170 prevents the knuckle pin 1100 from falling through the knuckle pin opening in the coupler. The second ring 1170 is spaced above the top of the coupler when the knuckle pin 1100 is positioned in the coupler and knuckle. Thus, the second ring 1170 and the area of the body 1110 between the first ring 1140 and the second ring 1170 provide a removal head that enables a person to grip the knuckle pin 100 and remove the knuckle pin 1100 from the coupler and the knuckle for inspection, repair, replacement, or other purposes.

Like knuckle pin 100, this illustrated example knuckle pin 1100 is a monolithically formed steel member. In this example, the first ring 1140 is welded to the outer surface 1122 of the wall 1120 of the body 1110. Likewise, in this example, the second ring 1170 is welded to the outer surface 1122 of the wall 1120 of the body 1110. It should be appreciated that these components can be otherwise formed in accordance with the present disclosure.

Like with knuckle pin 100, it should further be appreciated that the wall 1120 of the body 1110, the first ring 1140, and the second ring 1170 are configured and formed to co-act to provide a desired approximately of flexibility to enable the knuckle pin 1100 to absorb significant bending forces placed on the knuckle pin 1100 by a knuckle and/or coupler while minimizing fatigue, thereby substantially reducing the likelihood of failure of the knuckle pin 1100.

In this illustrated example embodiment, the wall 1120 of the body 1110 of the knuckle pin 1100 has a length or height of approximately 340 millimeters (approximately 13.375 inches). In this illustrated example embodiment, the wall of the body has a thickness of approximately 3 millimeters (approximately 0.125 inches). In this illustrated example embodiment, the wall 1120 of the body 1110 has an outer diameter of approximately 41 millimeters (approximately 1.6 inches). In this illustrated example embodiment, the wall of the body has an inner diameter of approximately 34 millimeters (approximately 1.35 inches). In this illustrated embodiment, the longitudinal slot in the body has a width of approximately 5 millimeters (approximately 0.1875 inches).

In this illustrated example embodiment, the first ring has a thickness of approximately 3 millimeters (approximately 0.125 inches). In this illustrated example embodiment, the first ring 1140 has an outer diameter of approximately 57 millimeters (approximately 2.25 inches). In this illustrated example embodiment, the first ring has an inner diameter of approximately 41 millimeters (approximately 1.6 inches). In this illustrated example embodiment, the first ring has a depth of approximately 8.40 millimeters (approximately 0.33 inches). In this illustrated embodiment, the stress relief slots in the first ring each have a width of approximately 5 millimeters (approximately 0.1875 inches).

In this illustrated example embodiment, the second ring has a thickness of approximately 3 millimeters (approximately 0.125 inches). In this illustrated example embodiment, the second ring has an outer diameter of approximately 2 millimeters (approximately 1.8 inches). In this illustrated example embodiment, the second ring 1170 has an inner diameter of approximately 41 millimeters (approximately 1.6 inches). In this illustrated example embodiment, the second ring has a depth of approximately 2.50 millimeters (approximately 0.10 inches). In this illustrated embodiment, the stress relief slots in the second ring each have a width of approximately 5 millimeters (approximately 0.1825 inches).

In this illustrated embodiment, the knuckle pin 1100 weighs approximately 1 kilogram (approximately 2.2 pounds).

Like with knuckle pin 100, for reinforcement purposes, one or more annular beads (not shown) may be formed at the bases of one or more of the rings 1140 and/or 1170 and the wall 120 to provide additional attachment strength of the rings 1140 and 1170 to the wall 1120.

Figure 20:
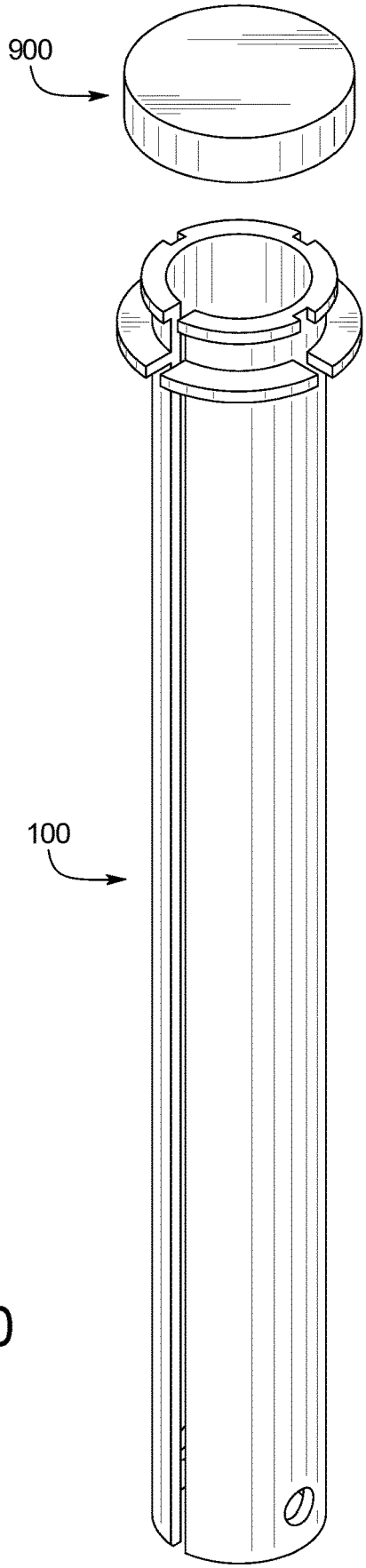
FIG. 20 is an exploded perspective view of the knuckle pin of FIGS. 2 to 11 and a cap configured to be attached to the top of the knuckle pin.

In various embodiments, the present disclosure also provides a cap configured to protect the interior of the body from debris. In various embodiments, the cap is configured to be inserted into the opening in the upper portions 112 or 1112 of the bodies 110 or 1110, respectively. One such example cap is shown in FIG. 20 in relationship to the knuckle pin 100.

It should be appreciated that the width of the elongated slot and each of the stress relief slots is constant for each respective slot. In alternative embodiments, the the width of one or more of the elongated slot and/or one or more of the stress relief slots is different in at least two spaced apart locations along that slot.

It should be appreciated that one or more parts of the knuckle pin of the present disclosure can be made in other suitable manners. For example, the one or more of the rings can be formed by a crimping process (instead of by welding onto the elongated wall).

It should be appreciated that the knuckle pin of the present disclosure can be made from other suitable materials besides metallic materials such as steel. In certain such embodiments, the knuckle pin is made from a suitable nonmetallic material such as a plastic material. In certain other embodiments, the knuckle pin is made from a combination of metallic and nonmetallic materials.

It will be understood that modifications and variations may be effected without departing from the scope of the novel concepts of the present invention, and it is understood that this application is to be limited only by the scope of the claims.

The invention is claimed as follows:

1. A railroad car coupler assembly knuckle pin comprising:

an elongated cylindrical tubular body having an upper end portion, a lower end portion spaced apart from the upper end portion, and an intermediate portion between and connecting the upper end portion and the lower end portion, the body including an elongated cylindrical wall having an outer surface and an inner surface that defines an elongated central opening that extends the length of the wall, the elongated cylindrical wall including two spaced apart elongated opposing surfaces that define an elongated slot that extends the length of the wall;

an annular first ring integrally connected to and outwardly extending from a first area of the upper end portion of the body; and an annular second ring integrally connected to and outwardly extending from a second area of the upper end portion of the body, the second ring is spaced apart from the first ring along the body;

wherein the first ring defines a plurality of first stress relief slots, the first ring including four equally sized sections, each section including a curved wall having a top surface, a bottom surface, a concave inner surface integrally connected to the outer surface of the wall of the body, a convex outer surface, a first end surface that partially defines one of the plurality of first stress relief slots, and a second end surface that partially defines another one of the plurality of first stress relief slots.

2. The railroad car coupler assembly knuckle pin of claim 1, wherein the second ring defines a plurality of second stress relief slots, the second ring including four equally sized sections, each section including a curved wall having a top surface, a bottom surface, a concave inner surface integrally connected to the outer surface of the wall of the body, a convex outer surface, a first end surface that partially defines one of the second stress relief slots, and a second end surface that partially defines another one of the second stress relief slots.

3. The railroad car coupler assembly knuckle pin of claim 1, wherein the second ring defines a plurality of second stress relief slots, the second ring including four equally sized sections, each section including a curved wall having a top surface, a bottom surface, a concave inner surface integrally connected to the outer surface of the wall of the body, a convex outer surface, a first end surface that partially defines one of the second stress relief slots, and a second end surface that partially defines another one of the second stress relief slots.

4. The railroad car coupler assembly knuckle pin of claim 1, wherein the first ring is sized diametrically larger than a knuckle pin opening and a coupler pin opening.

5. The railroad car coupler assembly knuckle pin of claim 1, wherein the second ring is sized diametrically larger than a knuckle pin opening and a coupler pin opening.

6. The railroad car coupler assembly knuckle pin of claim 1, wherein the body, the first ring, and the second ring are monolithically formed.

7. The railroad car coupler assembly knuckle pin of claim 6, wherein the body is steel, the first ring is steel, the first ring is welded to the outer surface of the wall of the body, the second ring is steel, and the second ring is welded to the outer surface of the wall of the body.

8. The railroad car coupler assembly knuckle pin of claim 1, wherein the opposing surfaces that define the elongated slot extend in intersecting planes.

9. The railroad car coupler assembly knuckle pin of claim 1, wherein the opposing surfaces that define the elongated slot extend in parallel planes.

10. The railroad car coupler assembly knuckle pin of claim 1, wherein the opposing surfaces that define the elongated slot extend in non-linear planes.

11. The railroad car coupler assembly knuckle pin of claim 1, wherein the lower end portion of the body defines a plurality of spaced apart aligned fastener receipt holes.

12. The railroad car coupler assembly knuckle pin of claim 1, wherein the elongated slot is non-linear.

13. The railroad car coupler assembly knuckle pin of claim 1, wherein the width of the elongate slot is constant.

14. The railroad car coupler assembly knuckle pin of claim 1, wherein the width of the elongated slot is different in at least two spaced apart locations along the elongated slot.

15. A railroad car coupler assembly knuckle pin comprising:

an elongated cylindrical tubular body having an upper end portion, a lower end portion spaced apart from the upper end portion, and an intermediate portion between and connecting the upper end portion and the lower end portion, the body including an elongated cylindrical wall having an outer surface and an inner surface that defines an elongated central opening that extends the length of the wall, the cylindrical wall including two spaced apart elongated opposing surfaces that define an elongated slot that extends the length of the wall;

a first annular ring integrally connected to and outwardly extending from a first area of the upper end portion of the body, wherein the first ring defines a plurality of first stress relief slots; and a second annular ring integrally connected to and outwardly extending from a second area of the upper end portion of the body, the second ring is spaced apart from the first ring along the body, wherein the second ring defines a plurality of second stress relief slots aligned with the first stress relief slots;

wherein the body, the first ring, and the second ring are monolithically formed; and wherein the body is steel, the first ring is steel, the first ring is welded to the outer surface of the wall of the body, the second ring is steel, and the second ring is welded to the outer surface of the wall of the body.

* * * * *